US006135732A

United States Patent [19]

Angorin

[11] Patent Number: 6,135,732

[45] Date of Patent: Oct. 24, 2000

[54] WELL PUMPING EQUIPMENT

[75] Inventor: David Mikhailovich Angorin, Almetevsk, Russian Federation

[73] Assignee: Otkrytoe Aktsionernoe Obschestvo "Almetevski Nasosnyi Zavod", Tartarstan, Russian Federation

[21] Appl. No.: 09/202,376

[22] PCT Filed: Jun. 6, 1997

[86] PCT No.: PCT/RU97/00184

§ 371 Date: Dec. 11, 1998

§ 102(e) Date: Dec. 11, 1998

[87] PCT Pub. No.: WO97/49920

PCT Pub. Date: Dec. 31, 1997

[51] Int. Cl.[7] ..... F04B 17/00

[52] U.S. Cl. ..... 417/423.3; 417/423.15

[58] Field of Search ..... 417/423.3, 423.15, 417/424.2, 425; 166/65.1, 66.4, 72, 73

[56] References Cited

U.S. PATENT DOCUMENTS 4,928,771 5/1990 Vandevier ..... 166/385

FOREIGN PATENT DOCUMENTS 0023126 1/1981 European Pat. Off. .
0508124 10/1992 European Pat. Off. .
2001313 10/1993 Russian Federation .
2050472 12/1995 Russian Federation .
1178947 9/1985 U.S.S.R. .
1262026 10/1986 U.S.S.R. .

*Primary Examiner*—Teresa Walberg
*Assistant Examiner*—Thor Campbell
*Attorney, Agent, or Firm*—Graybeal Jackson Haley, LLP

[57] ABSTRACT

A well pumping equipment comprises a pump (1) with an electric motor (2), each having its body suitable for location in a well using a tubing (3), a frequency converter (4) electrically coupled by a cable (5) to the electric motor (2) and including a rectifier (6) and inverter (7). The inverter (7) is adapted to be located in the well and is connected to the rectifier (6) by a single-conductor cable (5), while the other single-conductor connection line to supply power to the electric motor (2) and the inverter (7) is the electric connection of the motor (2) and inverter (7) bodies with the tubing (3).

2 Claims, 1 Drawing Sheet

WELL PUMPING EQUIPMENT

Field of the Invention

The present invention relates to production of oil and other formation fluids, and can be employed in submersible electric pumping.

BACKGROUND OF THE INVENTION

Known in the art is a submersible pump assembly comprising an electric motor having an electromechanical transducer shaft connected to a pump shaft, and a frequency converter electrically coupled to the electric motor (PCT, A1, WO 91/19905).

In this assembly, the converter is arranged in the area of the electric motor mount and is suitable for location with the submersible pump assembly directly in the well.

The problem with the pump assembly above is that a three-conductor cable should be used to supply power to the electric motor and the frequency converter. It makes the assembly less reliable and raises its operating cost, in particular, when the submersible pump assembly operates in the wells at large depths.

A well pumping system disclosed in Maximov V. P. "Adjustable Control of Submersible Pump System Drive", Moscow, 1981, pages 5,6, comprises a pump with an electric motor, each having its body suitable for location in a well using a tubing, and a frequency converter electrically coupled by a cable to the electric motor, the frequency converter including a rectifier and an inverter.

In this pump system, the frequency converter is located at the daylight surface in the vicinity of the well mouth and is connected by a multicore cable to the electric motor. In this case, voltage is also delivered to the electric motor by a three-conductor cable whose insulation has to meet stringent requirements. This raises the operating costs since the cable conductors are made of copper in order to provide the adequate electric connection, and failure of the insulation between the conductors may cause the risk of the system damage.

SUMMARY OF THE INVENTION

It is an object of the present invention to provide a well pumping equipment wherein the frequency converter design and connection to the electric motor permits the employment of a single-conductor cable to supply power to the submersible pump, ensuring thereby the reduction in the amount of metal per structure and making the equipment more cost effective and reliable.

The aforementioned object is attained by a well pumping equipment comprising a pump with an electric motor, each having its body suitable for location in the well using a tubing, a frequency converter electrically coupled by a cable to the electric motor and including a rectifier and inverter, wherein in accordance with the invention the inverter is adapted to be located in the well, an input bus of the inverter being connected to a first output bus of the rectifier by a single-conductor cable, while the other singleconductor connection line to supply power to the electric motor and the inverter is the electric connection of the motor and inverter bodies with the tubing which is electrically coupled to a second output bus of the rectifier.

The above features and advantages of the present invention will be apparent from the following description of its best embodiment, token in conjunction with the accompanying drawing.

DESCRIPTION OF THE BEST EMBODIMENT OF THE INVENTION

Figure 1:
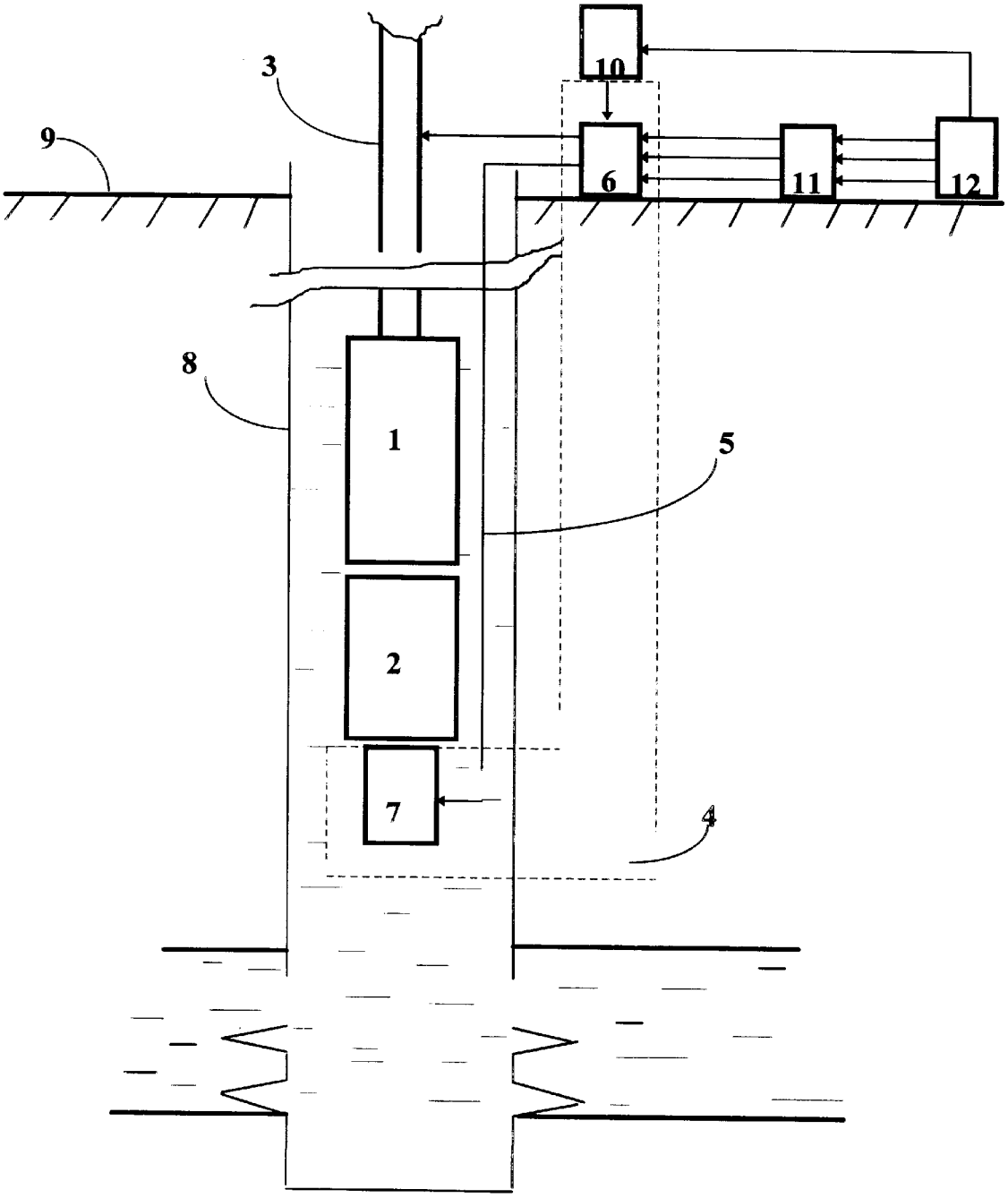
FIG. 1 is a schematic view of a well pumping equipment of the present invention.

Referring to FIG. 1, a well pumping equipment comprises a pump 1 with an electric motor 2, each having its body suitable for location in a well using a tubing 3, a frequency converter 4 electrically coupled to the electric motor 2 by a cable 5 and including a rectifier 6 and an inverter 7. In accordance with the invention, the inverter 7 is adapted to be located in the well and is coupled to a first output bus of the rectifier 6 by a single-conductor cable 5, while the other single-conductor connection line to supply power to the electric motor 2 and to the inverter 7 is the electric connection from the electric motor 2 and inverter 7 bodies to the tubing 3 which is electrically coupled to a second output bus of the rectifier 6.

In addition, FIG. 1 schematically depicts a lifting pipe string 8 and a daylight surface 9, and control units commonly used in the systems to perform specific functions, which are known in the art and do not form the subject matter of the present invention, such as a rectifier control unit I0, a transformer 11 and a control station 12.

A well pump equipment in accordance with the invention operates as follows.

A three-phase supply current voltage with a frequency of 50Hz, delivered from a control station 12, is converted by a transformer 11 into a nominal voltage required to operate an electric motor 2, e.g. 750 V to 2300 V, depending on the electric motor 2 power. The nominal voltage is fed to an input of a frequency converter 4 which converts the 50 Hz frequency voltage into the voltage of the same magnitude with the frequency spectrum adjustable in the range from 0 Hz to 100 Hz. Direct voltage from a rectifier 6 is supplied over a single-conductor cable 5 to an input of an inverter 7. The inverter 7 converts the magnitude-controlled direct voltage into the frequency-controlled alternating voltage and feeds it to an input of the electric motor 2 so that to start up the electric motor 2 at the supply voltage frequency required for particular operating conditions of the pump.

Owing to removing the inverter 7 from the part of the frequency converter 4, arranged at the daylight surface, and locating it in the immediate vicinity of the electric motor 2, power can be supplied to the inverter 7 by a single-conductor cable, while the tubing 3 is the other single-conductor connection line to supply power. The above arrangement of the inverter 7 eliminates the risk of damage caused by distracting the insulation between the conductors of the multicore cable, reduces the amount of metal per structure, improves the equipment cost efficiency owing to the smaller electric losses and the reduction in number of copper conductors from three to a single one, and enhances reliability owing to the reduced number of electric connections which most frequently fail in practice due to great distances run by the cable 5.

Industrial Applicability

A well pump equipment in accordance with the present invention is mostly useful in oil production, particularly, it can be employed to produce wells having considerable depths.

What is claimed is:

1. A well pumping equipment comprising a pump with an electric motor, each having its body suitable for location in a well using a tubing, a frequency converter electrically coupled by a cable to the electric motor, the frequency converter including a rectifier and an inverter, characterized in that the inverter is adapted to be located in the well, an input bus of the inverter being connected to a first output bus of the rectifier by a single-conductor cable, while the other single-conductor connection line for supplying power to the electric motor and the inverter is the electric connection of the motor and inverter bodies with the tubing which is electrically coupled to a second output bus of the rectifier.

2. A well pumping apparatus comprising:

a pump sized to fit within an electrically conducting well tubing and comprising a multiphase electric motor mechanically linked to a pump;

a frequency converter comprising a rectifier operatively coupled to a source of AC voltage and having a first output for providing DC voltage and a second output electrically coupled to the well tubing, and an inverter operatively coupled to the electric motor, the inverter having an input and an output wherein the inverter is adapted to be located in the well tubing; and a single conductor cable coupled to the first output of the rectifier and the input of the inverter whereby DC voltage delivered from the first output of the rectifier by the cable to the input of the inverter is converted to multiphase AC voltage for use by the motor.

* * * * *